US011644291B1

(12) United States Patent
Hansen et al.

(10) Patent No.: US 11,644,291 B1
(45) Date of Patent: May 9, 2023

(54) AUTOIGNITION MATERIAL CAPSULE

(71) Applicant: Karman Holdings, LLC, Huntington Beach, CA (US)

(72) Inventors: Stephanie J. Hansen, Woodinville, WA (US); Keith Krasnowski, Lynnwood, WA (US); Peter J. Golden, Seattle, WA (US); Michael Knollmeyer, Kirkland, WA (US); Minh Button, Mountlake Terrace, WA (US); Morgan Condit, Lake Forest Park, WA (US); Joel Hoksbergen, Bow, WA (US); Andrew Lindo, Mount Vernon, WA (US)

(73) Assignee: Karman Holdings, LLC, Huntington Beach, CA (US)

( * ) Notice: Subject to any disclaimer, the term of this patent is extended or adjusted under 35 U.S.C. 154(b) by 145 days.

(21) Appl. No.: 16/895,615

(22) Filed: Jun. 8, 2020

Related U.S. Application Data

(62) Division of application No. 15/391,418, filed on Dec. 27, 2016, now Pat. No. 10,677,576.

(60) Provisional application No. 62/273,165, filed on Dec. 30, 2015.

(51) Int. Cl.
*F42C 19/08* (2006.01)
*F42C 15/36* (2006.01)

(52) U.S. Cl.
CPC ..... *F42C 19/0815* (2013.01); *F42C 15/36* (2013.01); *F42C 19/0803* (2013.01); *F42C 19/08* (2013.01)

(58) Field of Classification Search
CPC .. F42C 19/08; F42C 19/0803; F42C 19/0815; F42C 15/36; F42C 19/02; F42B 39/14; F42B 39/20
USPC ..... 102/205
See application file for complete search history.

(56) References Cited

U.S. PATENT DOCUMENTS 4,561,675 A * 12/1985 Adams ..... B60R 21/2644 280/736
4,843,965 A 7/1989 Merzals
4,944,528 A * 7/1990 Nilsson ..... B60R 21/2644 422/165
5,046,429 A 9/1991 Swann et al.
5,186,491 A * 2/1993 Yoshida ..... B60R 21/2644 422/165
5,378,017 A * 1/1995 Lindsey ..... B60R 21/2644 280/736
5,427,030 A * 6/1995 Kidd ..... F42B 3/04 422/165

(Continued)

OTHER PUBLICATIONS

U.S. Appl. No. 15/391,418, Hansen et al., filed Dec. 27, 2016.

*Primary Examiner* — James S Bergin
(74) *Attorney, Agent, or Firm* — Lee & Hayes, P.C.

(57) ABSTRACT

Multistage thermal trigger devices disclosed herein may include a first stage and a second stage, wherein the first stage activates at a first temperature, and wherein the second stage activates at a second temperature. The first stage activates an arming assembly so that the second stage is armed. The second stage may then activate the output of the multistage thermal trigger device, via the arming assembly, when the second temperature is reached. An autoignition material (AIM) capsule is also disclosed herein. The AIM capsule may be deployed in connection with the disclosed multistage thermal trigger devices.

16 Claims, 5 Drawing Sheets

(56) References Cited

U.S. PATENT DOCUMENTS

| | | | | |
|---|---|---|---|---|
| 5,445,077 | A | 8/1995 | Dupuy et al. | |
| 5,762,370 | A * | 6/1998 | Lindsey | B60R 21/2644 280/741 |
| 5,834,679 | A * | 11/1998 | Seeger | C06B 29/00 102/288 |
| 6,408,759 | B1 | 6/2002 | Ewick et al. | |
| 7,377,545 | B2 * | 5/2008 | Kodama | B60R 21/2644 280/736 |
| 7,377,690 | B1 | 5/2008 | Diede | |
| 8,668,110 | B1 | 3/2014 | Traxler et al. | |
| 9,696,125 | B2 | 7/2017 | Merems | |
| 10,677,576 | B1 * | 6/2020 | Hansen | F42C 15/36 |
| 10,746,520 | B1 * | 8/2020 | Hall | F42B 39/14 |
| 2007/0240600 | A1 | 10/2007 | Skinner et al. | |

* cited by examiner

AUTOIGNITION MATERIAL CAPSULE

CROSS-REFERENCE TO RELATED APPLICATIONS

This is a divisional application claiming priority under 35 U.S.C. § 121 of co-pending U.S. patent application Ser. No. 15/391,418, entitled "MULTISTAGE THERMAL TRIGGER", filed on Dec. 27, 2016, issued as U.S. Pat. No. 10,677,576, which is a nonprovisional claiming priority under 35 U.S.C. § 119 of U.S. Provisional Patent Application No. 62/273,165, entitled "MULTISTAGE THERMAL TRIGGER", filed on Dec. 30, 2015. The prior applications are incorporated by reference herein.

STATEMENT OF GOVERNMENT SUPPORT

This invention was made in part with Government support under Agreement W15QKN-09-9-1001 awarded by the U.S. Department of Defense. The Government has certain rights in this invention.

BACKGROUND

Unless otherwise indicated herein, the materials described in this section are not prior art to the claims in this application and are not admitted to be prior art by inclusion in this section.

A thermal trigger may be used to activate, or "trigger" any system, such as fire safety systems and the like, responsive to temperature. It will be appreciated that there are a wide variety of current and potential future applications for thermal triggers. For example, thermal triggers may be used in virtually any environment presenting a risk of fire or overheating. Thermal triggers may be useful in building and vehicle safety, nuclear and coal fired power plants, electrical transmission lines and substations, storage of combustible or explosive materials, storage of fragile heat-sensitive materials, protection of supercomputers, protection of servers in datacenters, mining operations, rocket motor or fuel ignition systems, storage, transport, and tactical use of solid rocket motors, shipping containers for rocket motors or heat sensitive materials, explosives or hazardous waste, warheads, munitions, propulsion systems, combustion engines, and/or any number of other environments.

SUMMARY

A multistage thermal trigger device is disclosed. In some embodiments, multistage thermal trigger devices may include a first stage and a second stage, wherein the first stage activates at a first temperature, and wherein the second stage activates at a second temperature. The first stage may comprise, e.g., a thermal actuator which activates at the first temperature. The thermal actuator may be coupled with an arming assembly having a disarmed position and an armed position. The first stage may reposition the arming assembly from a disarmed position to an armed position in response to activation of the first stage.

The second stage may comprise, e.g., an autoignition material (AIM) capsule which activates at the second temperature, wherein the second temperature is higher than the first temperature. When the second stage is activated, it may in turn activate an output assembly via the arming assembly. The multistage thermal trigger may be configured such that the second stage may activate the output assembly when the arming assembly is in the armed position, and the output assembly cannot be activated by the second stage when the arming assembly is in the disarmed position.

An AIM capsule such as may be used in multistage thermal trigger devices is also disclosed herein. In some examples, AIM capsules may include a hermetically or environmentally sealed capsule; an autoignition material disposed inside the hermetically or environmentally sealed capsule; a gas permeable retainer system which retains the autoignition material in position; a stabilizer disposed inside the hermetically or environmentally sealed capsule; and a burst disc comprising a burst orifice for gas output upon activation of the autoignition material.

Additional aspects of this disclosure are described in further detail below.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
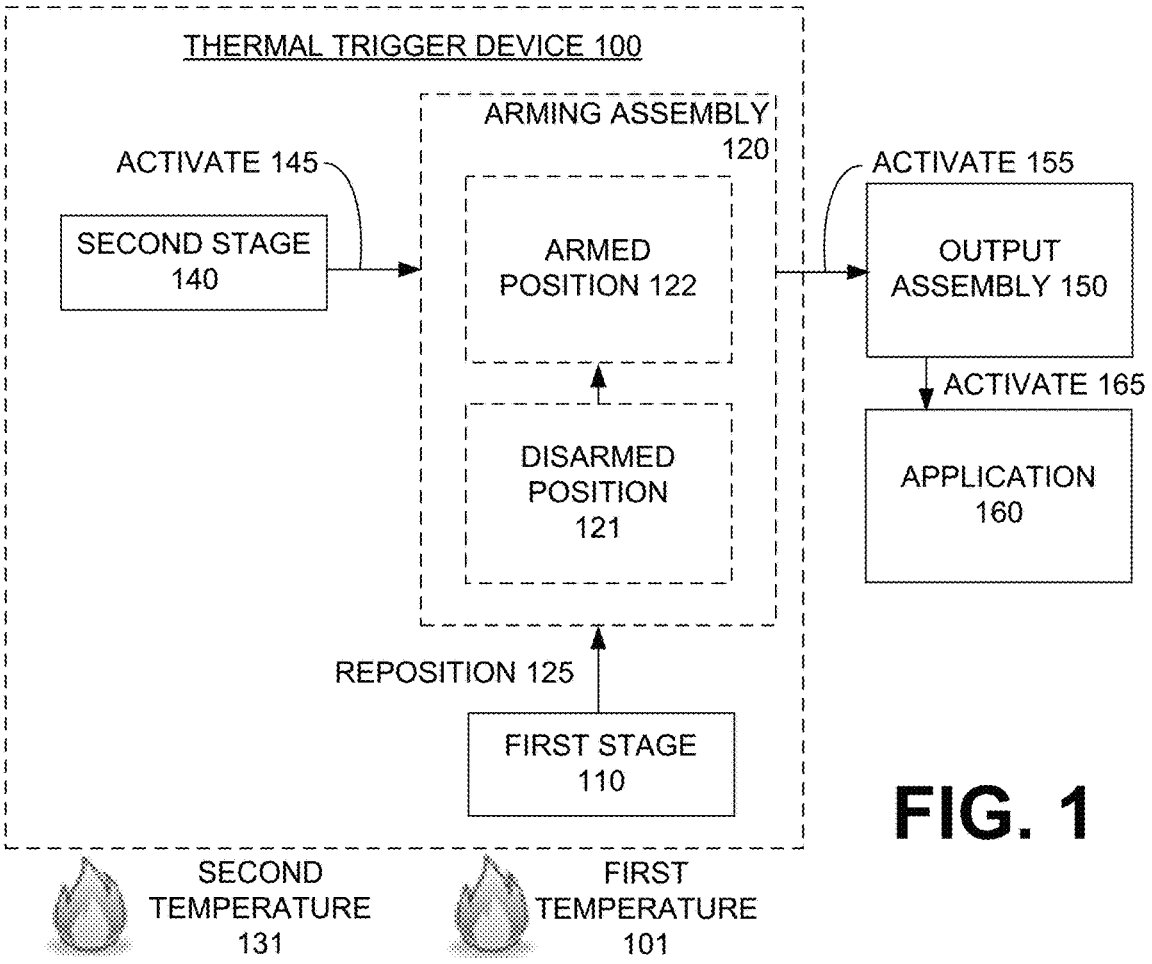
FIG. 1 is a block diagram illustrating an example multistage thermal trigger device and operation thereof to arm and initiate an application.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and made part of this disclosure.

The present disclosure is generally drawn, inter alia, to technologies including multistage thermal trigger devices and methods for manufacturing and operating such devices, as well as AIM capsules which may be deployed in connection with the disclosed multistage thermal trigger devices or other devices. In some embodiments, multistage thermal trigger devices may include a first stage and a second stage, wherein the first stage activates at a first temperature, and wherein the second stage activates at a second temperature. The first stage activates an arming assembly so that the thermal trigger device is armed. The second stage may then activate an output of the multistage thermal trigger device, via the arming assembly, when the second temperature is reached. If the arming assembly is not armed by the first stage, then the second stage is prevented from activating the output. Also, if the multistage thermal trigger device does not reach the second temperature, the second stage need not activate the output, even if the arming assembly is armed by the first stage. The multistage thermal trigger device may further include a mechanism to disarm the arming assembly when the thermal trigger device drops below the first temperature, and/or prior to reaching the second temperature, as well as a variety of other useful features disclosed herein.

This disclosure will generally use storage of combustible or explosive materials as an example scenario in which thermal triggers may be deployed, understanding that multistage thermal trigger devices may be deployed in any number of other scenarios as noted in the background section, and the disclosed multistage thermal trigger devices are not limited to any particular scenario. Energetic materials, such as explosives and propellants, are often found in confined spaces within munitions such as solid rocket motors. When these munitions are exposed to extreme heat (as from a fire) or when impacted by bullets or fragments from other munitions, the energetic materials may be initiated. Initiation of the propellants or explosives in this manner in a confined configuration leads to over pressurization of the munition followed by an explosion or detonation. This poses a significant hazard to military personnel, fire fighters and first responders in these scenarios.

Efforts have been made to develop "Insensitive Munitions," which are munitions that are generally incapable of detonation except in its intended mission to destroy a target. In other words, if fragments from an explosion strike an IM, if a bullet impacts the IM, or if the insensitive munition is in close proximity to a target that is hit, it is less likely that the insensitive munition will detonate. Similarly, if the insensitive munition is exposed to extreme temperatures, as from a fire, the insensitive munition will likely only burn, rather than explode. The extreme temperatures from a fire may be described as fast cook off (FCO) and slow cook off (SCO). To prove effectiveness, insensitive munitions may be tested in both FCO and SCO conditions. SCO may be described as a heating rate of 6° F./h or slower, and FCO may be described as direct impingement from a fuel fire with a flame temperature of up to 1600° F. or hotter within seconds. Multistage thermal trigger devices may respond in SCO and FCO environments, at faster and slower heating rates, and/or at heating rates in between those produced in SCO and FCO. Multistage thermal trigger devices may respond in any type fire or extreme heat environment.

One way that insensitive munitions may be made more insensitive is through active or passive mitigation approaches that include venting by splitting the case or ejecting the nozzle to increase the vent area and prevent over pressurization in FCO or SCO. Thus in some embodiments, multistage thermal trigger devices as disclosed herein may be configured to trigger thermally initiated venting systems or linear shaped charges (LSCs) installed on munitions and/or solid rocket motors. Multistage thermal trigger devices may be designed to respond to extreme fire conditions and initiate venting systems or LSCs. For example, the disclosed multistage thermal trigger devices may be adapted to initiate an output assembly comprising a detonation transfer line that is attached to an application comprising a linear shaped charge device that cuts or scores a munition casing.

FIG. 1 is a block diagram illustrating an example multistage thermal trigger device and operation thereof to arm and initiate an application, in accordance with at least some embodiments of this disclosure. The illustrated thermal trigger device 100 includes a first stage 110, a second stage 140 and an arming assembly 120. An output assembly 150 may optionally be included as a part of the thermal trigger device 100, or output assembly 150 may be a separate assembly.

In FIG. 1, the first stage 110 may be activated when a first temperature 101 is reached. In response to first temperature 101, the first stage 110 may reposition 125 the arming assembly 120 from a disarmed position 121 to an armed position 122. The second stage 140 may be activated when a second temperature 131 is reached. In response to second temperature 131, the second stage 140 may activate 145 the arming assembly 120. In response to activation 145 of the second stage 140, and when the arming assembly 120 is in the armed position 122, the arming assembly 120 may activate 155 the output assembly 150. In response to activation 155, output assembly 150 may activate 165 the application 160. Thus the thermal trigger device 100 and output assembly 150 may be used to activate 165 the application 160 after both the first temperature 101 and the second temperature 131 are reached.

Figure 2:
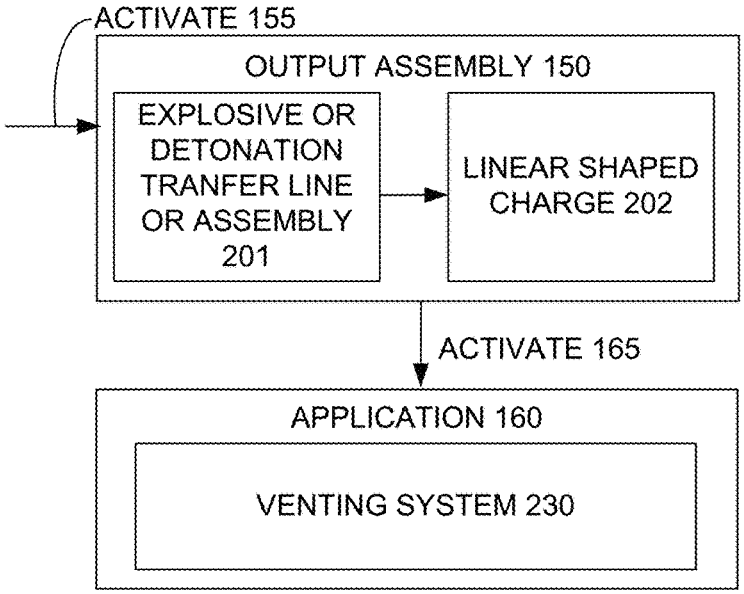
FIG. 2 is a block diagram illustrating an example output assembly and application.

FIG. 2 is a block diagram illustrating an example output assembly and application, in accordance with at least some embodiments of this disclosure. As illustrated in FIG. 2, in some embodiments, output assembly 150 may comprise, e.g., an explosive or detonation transfer line or assembly 201 and linear shaped charge 202. In some embodiments, explosive or detonation transfer line or assembly 201 may comprise, e.g., confined or flexible detonating cords or assemblies, or confined energy transfer lines. In some embodiments, output assembly 150 may comprise an assembly containing a primary or deflagrating propellant. Application 160 may comprise, e.g., a venting system 230 for a solid rocket motor or munition.

In FIG. 2, detonation transfer line 201 may be activated 155 by the thermal trigger device 100 illustrated in FIG. 1. In response to activation 155, detonation transfer line 201 may activate linear shaped charge 202. In response to activation of linear shaped charge 202, linear shaped charge 202 may in turn activate 165 venting system 230.

FIG. 2 illustrates one example output assembly 150 and application 160, however, it will be appreciated that thermal trigger devices disclosed herein may be used with a wide number of different output assemblies and applications. In general, output assemblies may comprise any structures operable to transfer activation outputs of thermal trigger devices to applications. Output assemblies may also comprise detonative or deflagration materials, or primary or secondary explosives or propellants. In general, applications may comprise any devices or systems which are advantageously activated in response to thermal conditions, such as second temperature 131, to which thermal trigger devices are adapted to respond.

In some embodiments, application 160 may comprise an electronic thermally initiated venting system, and the output assembly 150 may comprise, for example, a thermal battery and electronic or electromechanical safety and arming system, or a mechanical safety and arming system adapted to mechanically initiate the application 160. As noted herein, the output assembly 150 may optionally be integrated into the thermal trigger device 100.

Figure 3:
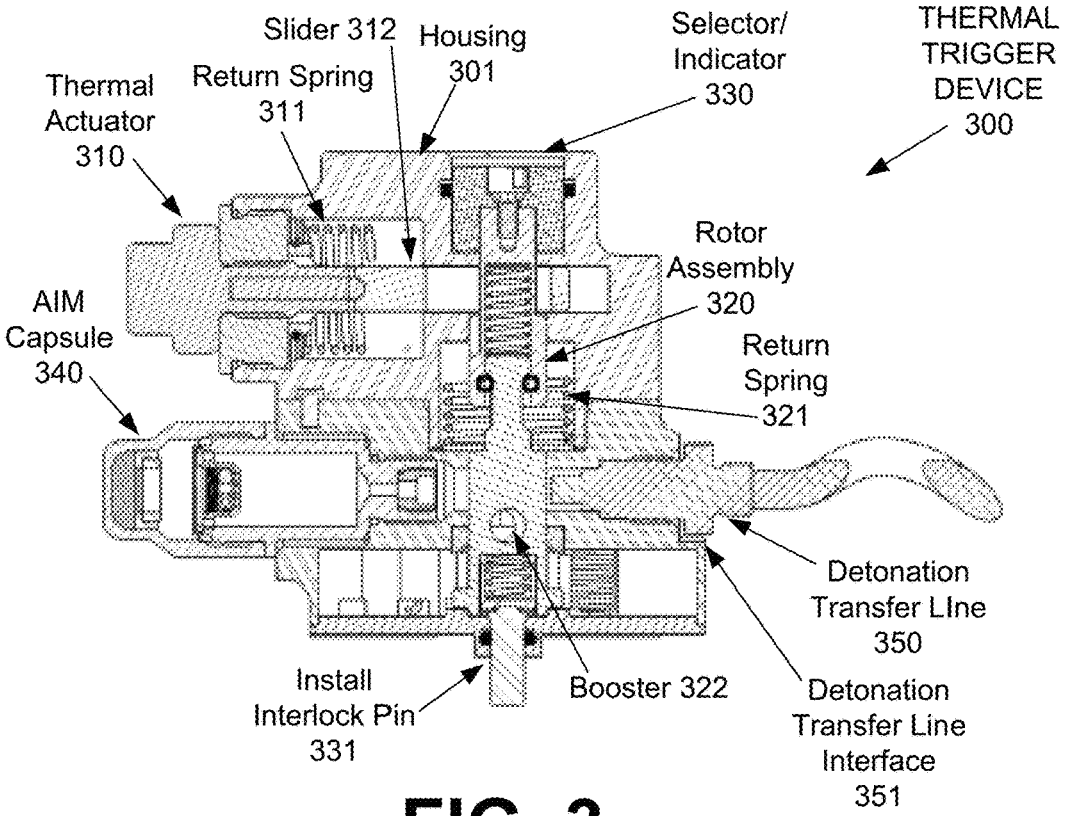
FIG. 3 is a side cross sectional view of an example uninstalled multistage thermal trigger device.
Figure 4:
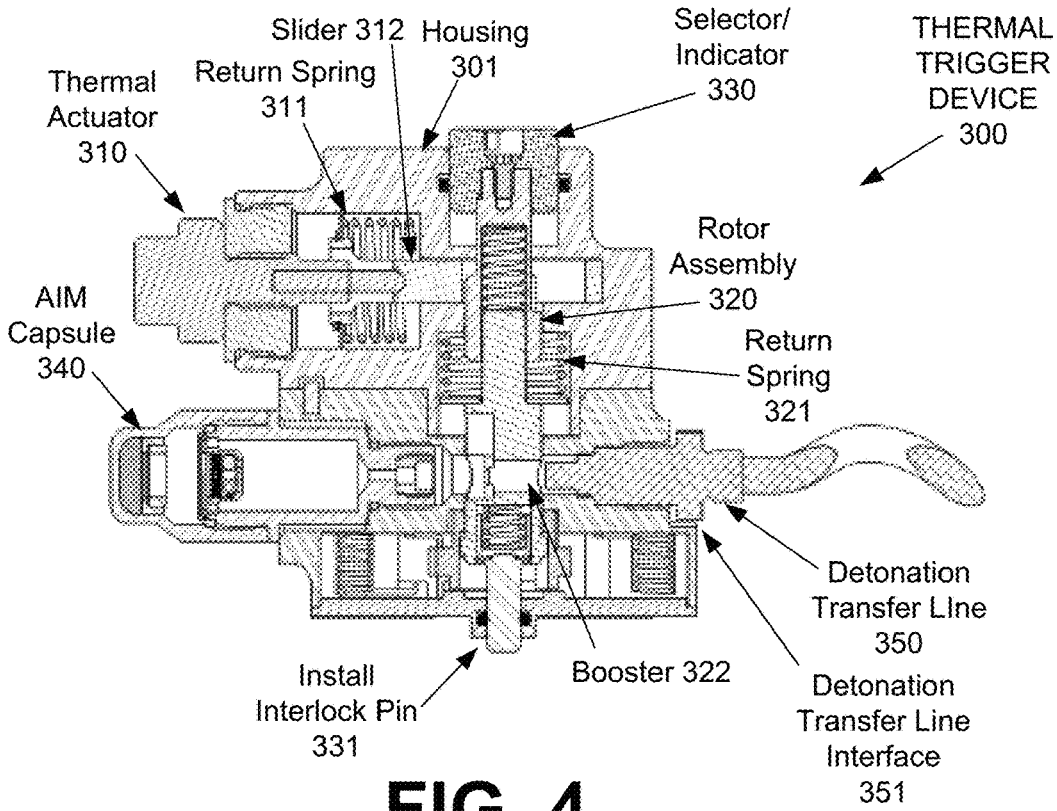
FIG. 4 is a side cross sectional view of an example installed multistage thermal trigger device.

FIG. 3 and FIG. 4 provide side cross sectional views of an example multistage thermal trigger device 300, showing internal components thereof, in accordance with at least some embodiments of this disclosure. The example multistage thermal trigger device 300 includes a housing 301, a thermal actuator 310, a return spring 311, a slider 312, a selector/indicator 330, an AIM capsule 340, a rotor assembly 320, a return spring 321, a booster 322, an install interlock pin 331, and a detonation transfer line interface 351. FIG. 3 furthermore illustrates an output assembly comprising a detonation transfer line 350, which is plugged into the detonation transfer line interface 351.

In FIG. 3 and FIG. 4, thermal actuator 310 implements the first stage 110 illustrated in FIG. 1. Rotor assembly 320 and booster 322 implement the arming assembly 120 illustrated in FIG. 1. AIM capsule 340 implements the second stage 140 illustrated in FIG. 1.

In FIG. 3 and FIG. 4, the rotor assembly 320 has a disarmed position in which booster 322 comprising a detonator material is rotated out of line from the AIM capsule 340 and the detonation transfer line 350. The rotor assembly 320 has an armed position in which the booster 322 is rotated in line with the AIM capsule 340 and the detonation transfer line 350. The thermal actuator 310 is coupled via an arming slider 312 with the rotor assembly 320, in order to rotate the booster 322 from the disarmed position to the armed position, in response to activation of the thermal actuator 310.

Initiation of the detonation transfer line 350 by the multistage thermal trigger device 300 illustrated in FIG. 3 and FIG. 4 may involve the following steps: The multistage thermal trigger device 300 may be installed, thereby depressing the install interlock pin 331. The selector/indicator 330 may be manually set to an "enable" position, which is discussed further in connection with FIG. 5 and FIG. 6. Thermal stimuli at first temperature 101 may activate the first stage thermal actuator 310 to thereby arm the multistage thermal trigger device 300. Thermal stimuli at second temperature 131 may initiate the second stage AIM capsule 340. The second stage AIM capsule 340 may in turn initiate the booster 322 in the rotor assembly 320. The booster 322 may in turn initiate the detonation transfer line 350.

FIG. 3 illustrates an uninstalled thermal trigger device 300, while FIG. 4 illustrates an installed thermal trigger device 300, with an arming assembly in an armed position. The install interlock pin 331 provides an example interlock which prevents the thermal trigger device 300 from entering the enable mode unless the thermal trigger device 300 is installed. Those of skill in the art will appreciate that other interlock structures may be employed in some embodiments. Interlocks may be engaged when the thermal trigger device 300 is installed, and disengaged when the thermal trigger device 300 is not installed.

In the uninstalled thermal trigger device 300 illustrated in FIG. 3, the install interlock pin 331 remains in an extended position relative to housing 301. The install interlock pin 331 is coupled with the rotor assembly 320 so that, when the install interlock pin 331 is in the extended position, the booster 322 is positioned out of line, in a different plane, from the output of the AIM capsule 340 and detonation transfer line 350, as illustrated in FIG. 3. If the AIM capsule 340 were to fire in an uninstalled thermal trigger device 300 such as illustrated in FIG. 3, the rotor assembly 320 would block the output of the AIM capsule 340 and/or output of the booster 322 in the rotor assembly 320 so that detonation transfer line 350 would not be successfully activated.

In the installed thermal trigger device 300 illustrated in FIG. 4, the install interlock pin 331 is depressed into an engaged position relative to housing 301. The install interlock pin 331 is coupled with the rotor assembly 320 so that, when the install interlock pin 331 is in the engaged position, the booster 322 is in a same plane as the output of the AIM capsule 340, as illustrated in FIG. 4. However, the booster 322 is still out-of-line with the AIM capsule 340 and detonation transfer line 350.

If the AIM capsule 340 were to fire in an installed thermal trigger device 300 such as illustrated in FIG. 4, the rotor assembly 320 may or may not block the output of the AIM capsule 340 to prevent activation of the booster 322 and the detonation transfer line 350 from successfully activating, depending on whether and booster 322 is rotated into an armed or disarmed position by rotor assembly 320. FIG. 4 illustrates booster 322 in an armed position, indicating that thermal actuator 310 has been activated at first temperature 101, and thermal actuator 310 has therefor repositioned the rotor assembly 320 into the armed position. If the AIM capsule 340 were to fire with booster 322 in the armed position as illustrated in FIG. 4, the output of the AIM capsule 340 would activate booster 322 and the booster 322 would in turn activate the detonation transfer line 350.

In some embodiments, the install interlock pin 331 may be replaced by, or supplemental to, a lock-out mechanism. Example lock-out mechanisms may generally prevent the thermal trigger device 300 from entering certain modes. For example, in some embodiments, a lock-out mechanism may prevent manual engagement of install interlock pin 331. In some embodiments, a lock-out mechanism may prevent rotation or translation of the rotor assembly 320 or equivalent functionality. In some embodiments, a lock-out mechanism may prevent manual switching of thermal trigger device 300 into an enable mode, which is discussed in further detail in connection with FIG. 5 and FIG. 6. Lock-out mechanisms may be disabled, e.g., by use of a special tool, key, or electronic signal, in order to install and enable thermal trigger device 300.

When the thermal trigger device 300 is installed, the selector/indicator 330 may indicate when the arming assembly 320 is in a "safe" mode, an "enabled" mode, or an "armed" mode. In some embodiments, the selector/indicator 330 may be manually set to an "enable" position, which is discussed further in connection with FIG. 5 and FIG. 6. When enabled, the multistage thermal trigger device 300 arms at the desired first temperature 101. The thermal actuator 310 moves the arming slider 312, which rotates the rotor assembly 320. The mechanical barrier of a rotor assembly 320 sidewall rotates out of line, while the booster 322 in the rotor assembly 320 rotates in-line with the AIM capsule 340 and detonation transfer line 350, as illustrated in FIG. 4.

In some embodiments, the thermal actuator 310 may contain, e.g., any thermal expansion or contraction material which expands or contracts when heated. In some embodiments, the thermal actuator 310 may contain a melt plug, eutectic material, or other thermally responsive material. In some embodiments, the thermal actuator 310 may contain a paraffin blend which may be customized to activate at a desired first temperature 101. The paraffin blend may expand and contract to move thermal actuator 310 and arming slider 312. Paraffin blend thermal actuators can be customized to actuate at desired arming temperatures up to, e.g., approximately 300° F. or higher. If the thermal stimuli is removed before reaching the critical temperature to activate AIM capsule 340, the paraffin in the thermal actuator 310 may retract, returning the booster 322 in the rotor assembly 320 out of line with the AIM capsule 340, and returning the mechanical barrier of a rotor assembly 320 sidewall back in line with the AIM capsule 340, so the thermal trigger device 300 is again disarmed and re-safed.

FIG. 3 and FIG. 4 illustrate various springs, including actuator return spring 311 and rotor assembly return spring 321. Return springs 311 and 321 may return the thermal actuator 310 and rotor assembly 320 from the armed position to the disarmed position when the thermal actuator 310 is deactivated. The thermal actuator 310 may deactivate, for example, when the temperature drops below the first temperature 101 and the paraffin wax blend in the thermal actuator 310 contracts. The illustrated return springs 311 and 321 are one example means to return the rotor assembly 320 from the armed position to the disarmed position when the thermal actuator is 310 deactivated, however it will be appreciated that other means, such as magnets, compressible foam, electronic motors or otherwise, may replace or supplement the illustrated springs 311 and 321. FIG. 2 also illustrates a variety of other features which will be understood by those of skill in the art with the benefit of this disclosure.

The illustrated rotor assembly 320 is one embodiment of an arming assembly 120, however it will be appreciated that other arrangements, such as slider assemblies, linear motion assemblies, piston assemblies, electrically activated assemblies, magnet assemblies, pivot assemblies and any number of other arrangements may be employed as an arming assembly 120, with the benefit of this disclosure. When the illustrated rotor assembly 320 is in the disarmed position, the multistage thermal trigger device 300 has a mechanical barrier, in the form of a rotor assembly 320 sidewall, between the AIM capsule 340 and the detonation transfer line 350. Furthermore, there is a mechanical barrier (a rotor assembly 320 sidewall) between the booster 322 and the detonation transfer line 350.

In some embodiments, the AIM capsule 340 and booster 322 may contain "primary" explosives while the detonation transfer line 350 may comprise a "secondary" explosive. The illustrated example multistage thermal trigger device 300 includes a mechanical barrier between the primary and the secondary explosives. Such arrangements are particularly useful for scenarios in which certain primary explosives are not approved for use which is "in-line" with secondary explosives. In FIG. 3, the AIM capsule 340 and booster 322 are out of line with the detonation transfer line 350 due to the mechanical barrier of the rotor assembly 320 sidewall.

Booster 322 may be employed to boost the output of AIM capsule 340. In some embodiments, the booster 322 may comprise a deflagrating or detonating propellant or explosive, e.g., boron potassium nitrate ($BKNO_3$), lead azide and/or hexanitrostilbene (HNS) or similar type propellants. When the rotor assembly 320 is repositioned into the armed position, the booster 322 is repositioned between the AIM capsule 340 and the detonation transfer line 350. When the AIM capsule 340 fires, it activates the booster 322 which in turn activates the detonation transfer line 350 inserted in the detonation transfer line interface 351.

It will be appreciated that booster 322 need not be included in some embodiments. For example, in an "inert barrier" embodiment, rotor assembly 320 may omit booster 322, and rotor assembly 320 may instead simply remove an inert mechanical barrier between AIM capsule 340 and detonation transfer line 350, so that AIM capsule 340 activates detonation transfer line 350 without the added benefit of booster 322. In a "deflagration output" embodiments, booster 322 may comprise a material designed to burn rather than detonate. In another embodiment, the AIM capsule 340 output may activate a propellant or other type output assembly.

AIM capsule 340 may comprise an autoignition material or propellant that automatically ignites at a specified second temperature 131. The second temperature 131 may comprise any temperature which is higher than the first temperature 101. After the multistage thermal trigger device 300 is armed at the first temperature 101 as described herein, and as the temperature of the multistage thermal trigger device 300 increases past second temperature 131, the autoignition material in the AIM capsule 340 ignites and triggers a pyrotechnic train to initiate the detonation transfer line 350 and ultimately to activate the application 160. The AIM capsule 340 is described in further detail in connection with FIGS. 7-10.

While FIGS. 3 and 4 illustrate a thermal actuator 310 and AIM capsule 340 as a first stage 110 and second stage 140, respectively, this is only one example implementation and those of skill in the art will appreciate that other implementations are possible. For example, an electronic embodiment may use a thermometer and a computing device or electronic logic circuits to implement the first stage 110 and second stage 140. The computing device may be adapted to activate an electronic motor to reposition arming assembly 120 when first temperature 101 is reached, and the computing device may be adapted to electronically activate an explosive or other output when second temperature 131 is reached.

While FIGS. 3 and 4 illustrate a thermal actuator 310 and AIM capsule 340 as a first stage 110 and second stage 140, respectively, this is only one example implementation and those of skill in the art will appreciate that other implementations are possible. For example, the AIM capsule output may be used to pressurize a cavity to activate an actuator, piston or stabber mechanism that in-turn activates the booster or detonator in the rotor assembly or output assembly.

FIGS. 3 and 4 illustrate an output assembly 150 implemented as the detonation transfer line 350. The detonation transfer line 350 comprises an end tip which fits into detonation transfer line interface 351 in the thermal trigger device 300. Detonation transfer lines may also be referred to as detonation cords, and include Flexible Confined Detonation Cord Assemblies (FCDCAs) and FCDCs, explosive transfer lines or assemblies, confined or flexible detonating cords or assemblies, and confined energy transfer lines. The detonation transfer line 150 may be activated by the AIM capsule 340 or booster 322, via the rotor assembly 320, when the AIM capsule 340 activates and the rotor assembly 320 is in the armed position and the booster 322 is activated. The detonation transfer line 350 cannot be activated by the AIM capsule 340 or the booster 322 when the rotor assembly 320 is in the disarmed position.

In some embodiments, multistage thermal trigger devices disclosed herein may respond within suitable temperature ranges in slow cook-off (SCO) and fast cook-off (FCO)

environments, and may initiate thermally initiated venting systems to prevent catastrophic failure of solid rocket motors. An insensitive munition thermal sensor design, such as illustrated in FIGS. 3 and 4, may use autoignition material in a safe-and-arm assembly to self-initiate a pyrotechnic train to initiate a linear shaped charge. This approach decreases venting system complexity by decreasing the number of system and subsystem components, and can also provide fast and effective response times. Furthermore, example thermal trigger devices may optionally respond solely to thermal stimuli from the SCO/FCO event and need not require batteries or electrical input. Example trigger safe/arm assemblies may isolate the thermal sensing mechanisms from the linear shaped charge and prevent unintended initiation of the solid rocket motor venting system. This technology can be tailored for various solid rocket motor propellants with varying cook-off temperatures and is adaptable for thermally initiated venting systems, other venting mechanisms, and rocket motor safe-and-arm ignition systems.

Embodiments of this disclosure may implement any desired event sequencing within a multistage thermal trigger device, as a function of temperature. For example, in some embodiments, multistage thermal trigger devices may be designed activate the first stage 110 at a first temperature 101 around 100° C.-120° C., and to activate the second stage 140 at a second temperature 131 around 120° C.-140° C. Other examples may activate the first stage 110 and/or second stage 140 at higher or lower temperatures, with the proper event sequencing for the first and second stages 110, 140, such that the first stage 110 is activated prior to the second stage 140 at all heating rates and in FCO. Multistage thermal trigger devices may arm at a first temperature 101 which is below the second temperature 131 at which the second stage 140 activates, in order to provide a desired margin below the second temperature 131 at which the AIM in the second stage 140 ignites, while also delaying arming as long as possible to maximize time for firefighter response. In FCO conditions, this margin may allow for proper event sequencing and a fast response time, e.g., within less than 1 minute, or within an amount of time otherwise shorter than cook off of a solid rocket motor.

Figure 5:
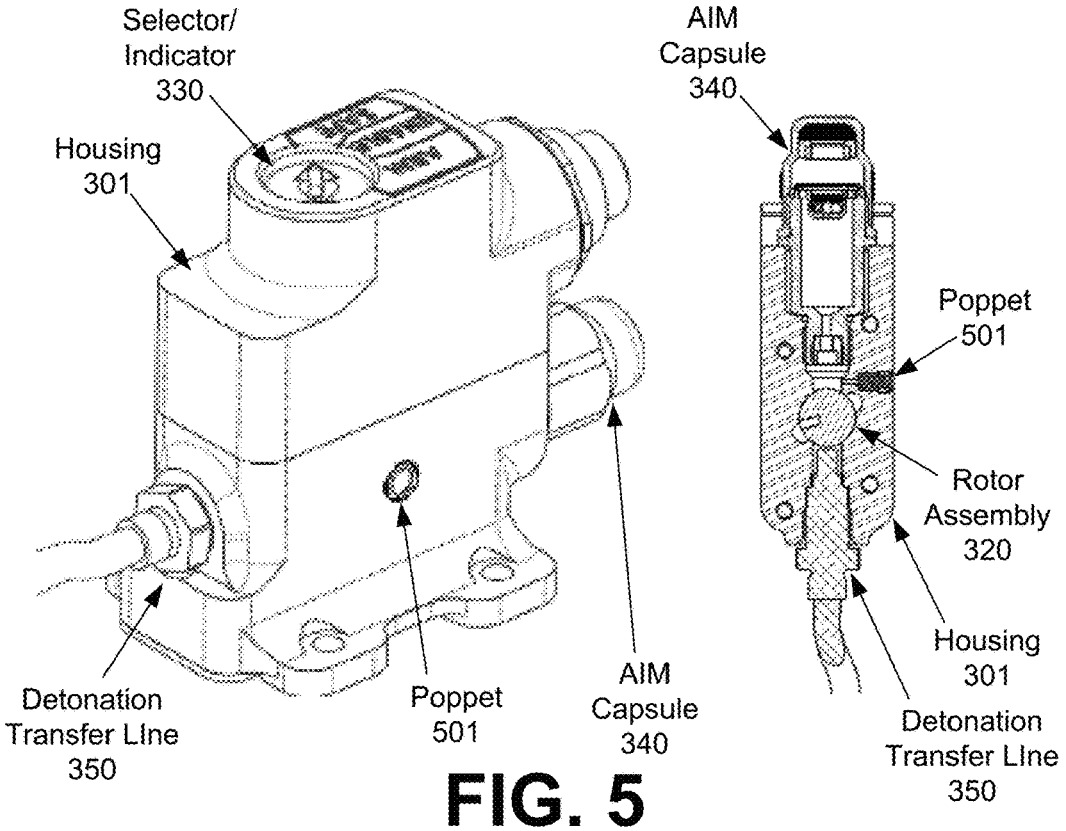
FIG. 5 is a perspective view and top cross sectional view of an example multistage thermal trigger device.
Figure 6:
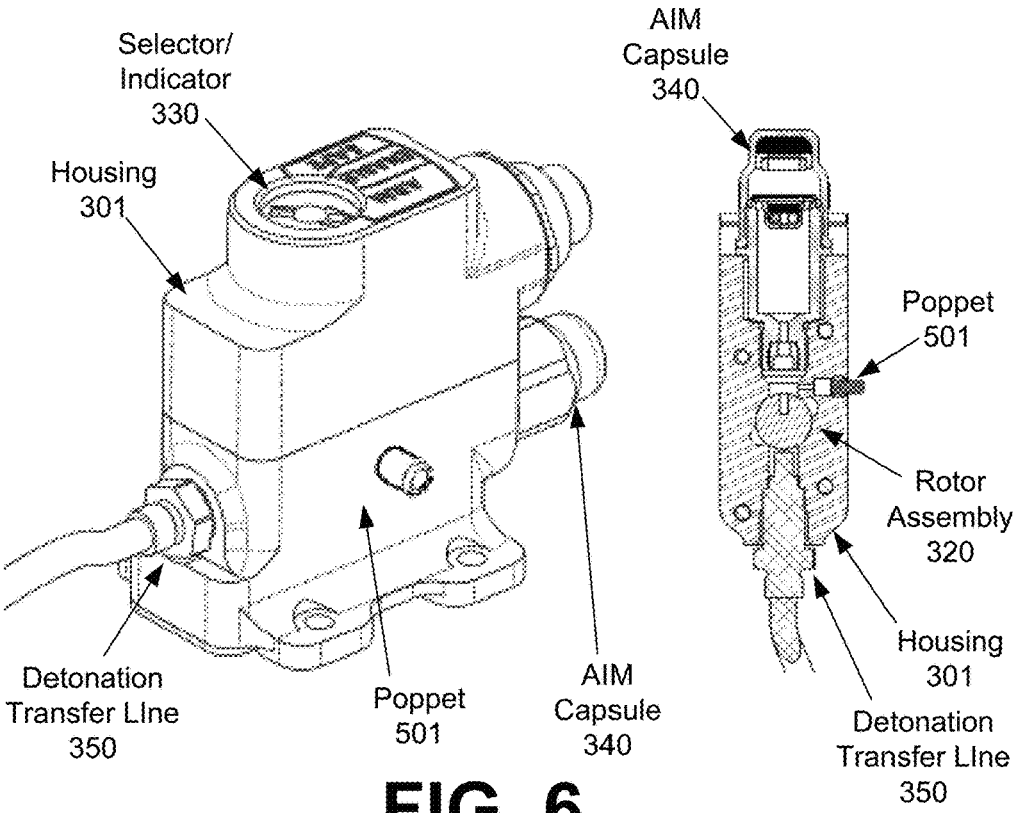
FIG. 6 is a perspective view and top cross sectional view of an example multistage thermal trigger device.

In some embodiments, features of example multistage thermal trigger devices may include, inter alia: (1) thermal trigger device can be tuned to desired second temperature 131 by modifying AIM blend in AIM capsule 340, (2) AIM capsule 340 may contain autoignition material or propellant in a hermetically sealable capsule to ensure stability, shelf life, and performance, and (3) thermal trigger device response temperature may be consistent or variable over SCO heating rates of 6° F./h, 45° F./h, 100° F./h and FCO FIG. 5 and FIG. 6 provide perspective views and top cross sectional views of an example multistage thermal trigger device, in accordance with at least some embodiments of the present disclosure. In FIG. 5 and FIG. 6, like elements introduced in FIG. 3 are assigned like identifiers. FIG. 5 and FIG. 6 illustrate, inter alia, housing 301, selector/indicator 330, rotor assembly 320, detonation transfer line 350, and AIM capsule 340. FIG. 5 and FIG. 6 also illustrate a poppet 501.

In FIG. 5 and FIG. 6, the selector/indicator 330 comprises a safe mode, an enable mode, and an arm mode. In FIG. 5, the selector/indicator 330 is in safe mode, and the rotor assembly 320 is correspondingly in a disarmed orientation. In FIG. 6, the selector/indicator 330 is in armed mode, and the rotor assembly 320 is correspondingly in an armed orientation.

In the safe mode, the thermal actuator 310 may be decoupled from the rotor assembly 320, or the rotor assembly 320 may be disabled or locked, so that the thermal actuator 310 does not move the rotor assembly 320 from the disarmed position to the armed position, even if the thermal actuator 310 is activated at the first temperature 101. In some embodiments, the selector/indicator 330 may be manually switched from the safe mode to the enable mode. In some embodiments, the selector/indicator 330 may be mechanically switched from the safe mode to the enable mode, e.g., in response to engaging the install interlock pin 331.

In the enable mode, the thermal actuator 310 is coupled with the rotor assembly 320, or the rotor assembly 320 is otherwise enabled, so that the thermal actuator 310 does move the rotor assembly 320 from the disarmed position to the armed position when the thermal actuator 310 is activated at the first temperature 101. However, the rotor assembly 320 remains in the disarmed position in enable mode, until rotor assembly 320 is repositioned into the armed position by thermal actuator 310. Thus in the enable mode, the selector/indicator 330 may point to enable, while the rotor assembly 320 remains in the disarmed orientation shown at the right side of FIG. 5.

The selector/indicator 330 may indicate arming assembly status. In the arm mode, the selector/indicator 330 may point to arm as illustrated in FIG. 6, while the rotor assembly 320 has been repositioned into the armed orientation shown at the right side of FIG. 6, by operation of thermal actuator 310.

In some embodiments, the multistage thermal trigger device 100 may include a selector for selecting between safe and enable modes, and a separate indicator for indicating whether the thermal trigger device 100 is disarmed or armed. In the illustrated embodiment, the "safe" and "enable" modes may be manually selected, and the multistage thermal trigger device enters indicates "arm" when the thermal actuator 310 arms the thermal trigger device 100. Thus, unlike "safe" and "enable", "arm" is not human selectable in such embodiments. Instead, "arm" is indicated responsive to activation of the thermal actuator 310. Of course, embodiments are also possible in which the thermal trigger device 100 may be manually armed, e.g., by moving selector/indicator 330 into arm mode.

FIG. 5 and FIG. 6 also illustrate a poppet 501. In FIG. 5, the poppet 501 remains unpopped, while in FIG. 6, the poppet 501 has popped. Poppet 501 may be adapted to have sufficient friction with housing 301 or a locking feature to generally hold poppet 501 in place once extended, while allowing poppet to move between the unpopped and popped positions under sufficient force. Poppet 501 indicates if any of the propellant or explosive components, such as AIM capsule 340 or booster 322, have initiated and/or if the thermal trigger device 100 has functioned. The initiation of any of the propellant or explosive components will force poppet 501 outward into the popped position illustrated in FIG. 6. In some embodiments, one or more additional poppets may be incorporated into thermal trigger device 100, e.g., to indicate whether thermal trigger device 100 is armed or has been previously armed. It will be appreciated that poppets are one structure for achieving desired indications, and that other structures, such as other expanding, extendable, or deformable structures, may provide similar indication functions.

Figure 7:
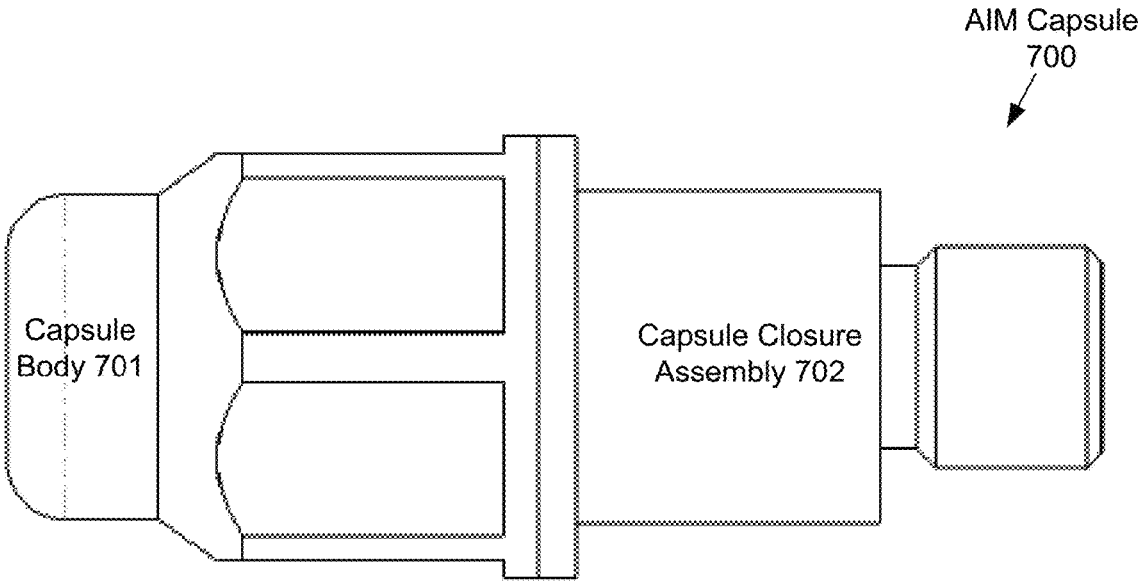
FIG. 7 illustrates an example AIM capsule which may be included in a multistage thermal trigger device.
Figure 8:
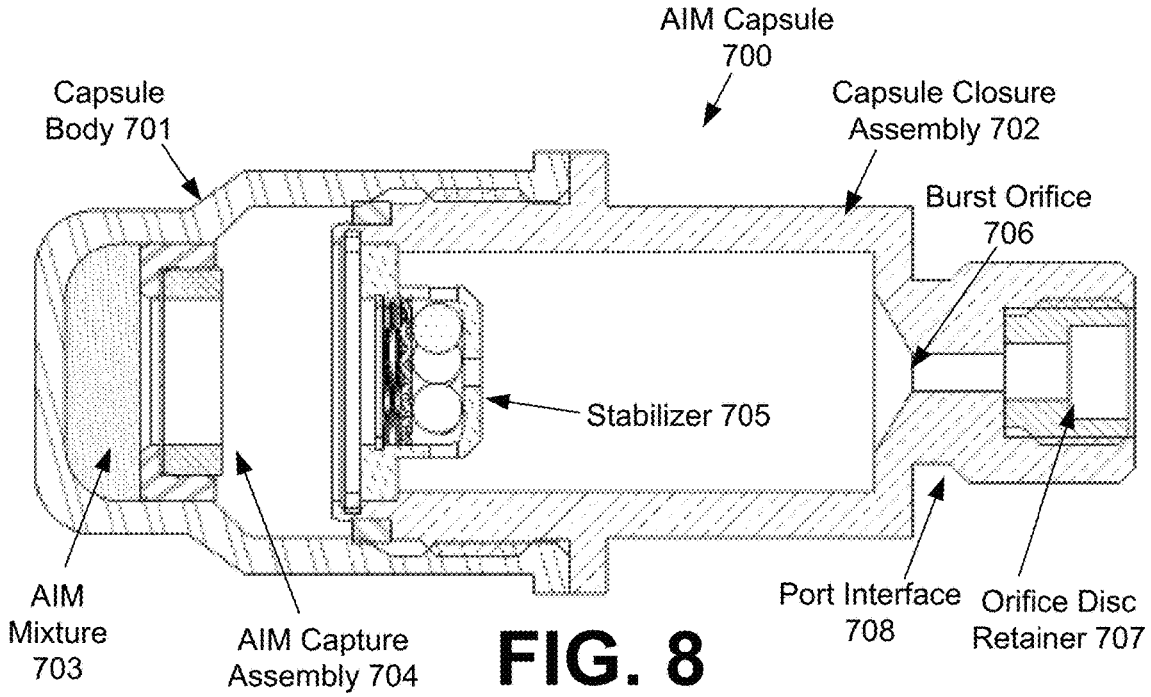
FIG. 8 illustrates a side cross sectional view the example AIM capsule illustrated in FIG. 7.

FIG. 7 illustrates an example AIM capsule which may be included in a multistage thermal trigger device, and FIG. 8 illustrates a side cross sectional view the example AIM capsule illustrated in FIG. 7, in accordance with at least some embodiments of the present disclosure. AIM capsule 700 may be included in a multistage thermal trigger device 300, e.g., as AIM capsule 340. The illustrated AIM capsule 700 includes a hermetically or environmentally sealed capsule formed by the illustrated capsule body 701 and capsule closure assembly 702. The illustrated AIM capsule 700 further includes an AIM mixture 703 or propellant disposed inside the AIM capsule 700; an AIM capture assembly 704 comprising, e.g., a gas permeable retainer system which retains the AIM mixture 703 in position; a stabilizer 705 such as a desiccant to remove moisture or a molecular sieve to trap gases formed during storage, aging, or use of AIM capsule 700; a burst orifice 706 for gas output upon activation of the AIM mixture 703, and an orifice disc retainer 707. The illustrated AIM capsule 700 may further include a port interface 708, e.g., threads or a particular interface shape for screwing or otherwise engaging the AIM capsule 700 in a thermal trigger device 300.

In FIG. 7 and FIG. 8, the AIM mixture 703 may include, e.g., an off-the-shelf autoignition material or propellant that is blended with a propellant booster such as boron potassium nitrate ($BKNO_3$). The AIM mixture 703 selection determines the response temperature (the second temperature), which may be adapted to suit desired temperature response requirements. The AIM mixture 703 may be blended with a booster selected based on the thermal output or pressure output needs for the pyrotechnic train or percussion primer to the detonation transfer line 350 or other output assembly.

In FIG. 7 and FIG. 8, the AIM capture assembly 704 may comprise a breathable filter that retains the AIM mixture 703 having particle sizes as low as <10 μm while allowing penetration of gases that form during storage and/or use of the AIM capsule 700. Any of a variety of materials may be used for the breathable filter. For example, in some designs, the breathable filter may comprise a cellulose material, e.g., a filter paper. In some designs, the breathable filter may comprise a metal mesh.

In FIG. 7 and FIG. 8, the orifice disc retainer 707 may provide a hermetic or environmental seal which may meter the gases and pressure inside the AIM capsule 700 during operation.

Figure 9:
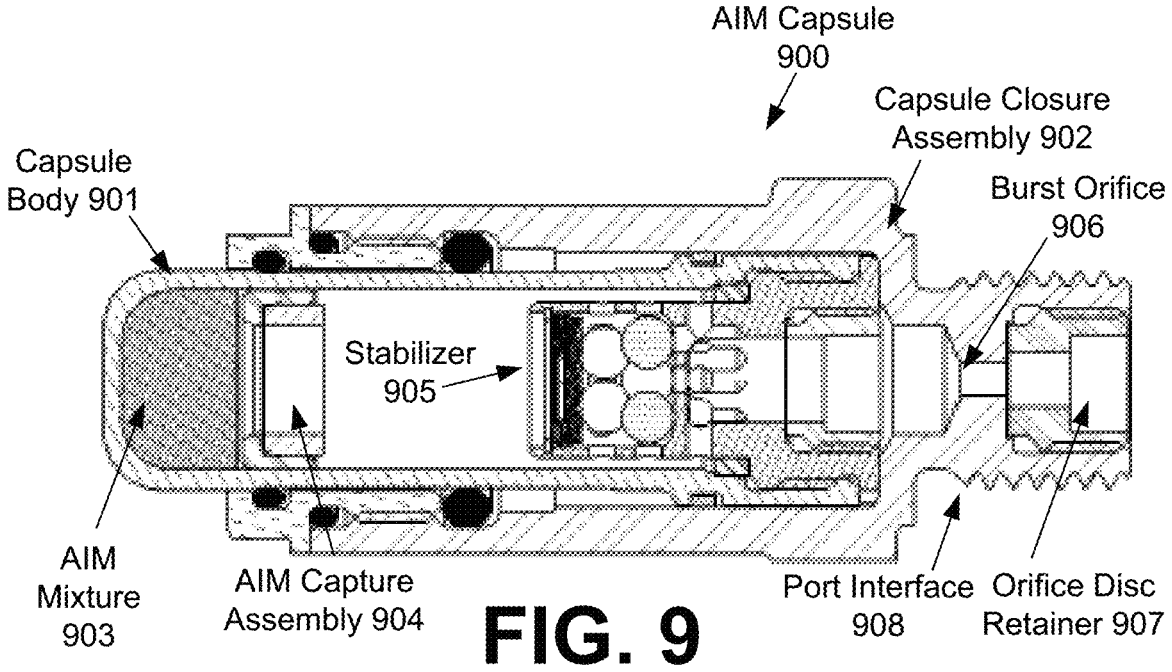
FIG. 9 illustrates a side cross sectional view of another example AIM capsule, prior to activation of the AIM capsule, which may be included in a multistage thermal trigger device.
Figure 10:
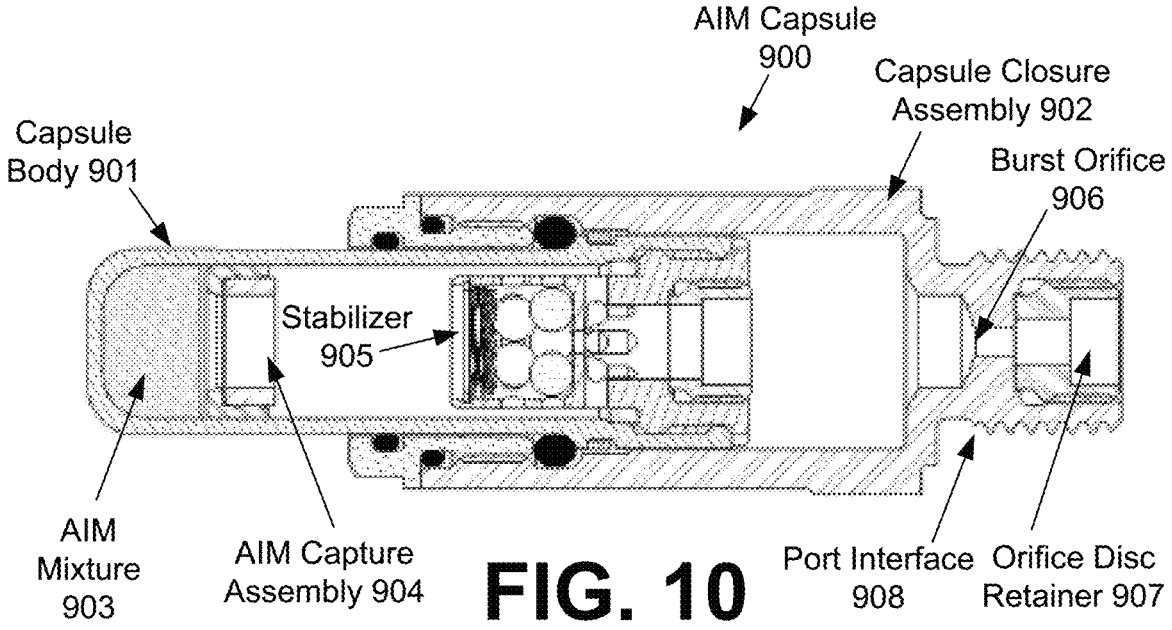
FIG. 10 illustrates a side cross sectional view the example AIM capsule illustrated in FIG. 9, after activation of the AIM capsule.

FIG. 9 illustrates a side cross sectional view of another example AIM capsule, prior to activation of the AIM capsule, which may be included in a multistage thermal trigger device; and FIG. 10 illustrates a side cross sectional view the example AIM capsule illustrated in FIG. 9, after activation of the AIM capsule, in accordance with at least some embodiments of the present disclosure. FIG. 9 and FIG. 10 include a capsule body 901 and capsule closure assembly 902; an AIM mixture 903; an AIM capture assembly 904; a stabilizer 905; a burst orifice 906, an orifice disc retainer 907; and a port interface 908.

In embodiments according to FIG. 9 and FIG. 10, the AIM capsule 900 may comprise two main parts: a slidable capsule body 901 inside a capsule closure assembly 902, wherein the slidable capsule body 901 slides outward from the capsule closure assembly 902 upon activation of the AIM mixture 903. FIG. 9 illustrates the AIM capsule 900 prior to activation, while FIG. 10 illustrates AIM capsule 900 after activation. In FIG. 10, the AIM capsule 900 has functioned and activated an integral extendable feature so that the AIM capsule 900 is in an extended position to indicate that it has functioned. The AIM capsule 900 may expand upon pressurization and serve as an indication that the AIM capsule 900 has been fired or is used or spent (inert). Various other elements such as a housing cap, sealing o-rings, hoopster snap ring, and dampening o-ring may stabilize and retain the slidable capsule body 901 inside the capsule closure assembly 902.

In FIGS. 7-10, the stabilizer 705, 905 may be disposed inside a holder assembly. The stabilizer and holder assembly do not obstruct gas flow out of the AIM capsules 700, 900 when the AIM mixture 703, 903 is activated. For example, the stabilizer 705, 905 may comprise a molecular sieve which may be sufficiently loose, permeable, and weakly bonded so that it is displaced when the AIM mixture 703, 903 is activated. The stabilizer 705, 905 may absorb any AIM mixture 703, 903 gaseous constituents or products or water which may evaporate out of the AIM mixture 703, 903 or may otherwise be trapped in the AIM capsules 700, 900. The stabilizer 705, 905 may include, e.g., a gas absorbing material such as a zeolite or silica. This serves to trap gases or water vapor that are formed or present during storage, aging or use of the AIM mixture 703, 903.

While a variety of dimensions, volumes, and materials may be used in different embodiments, a weight of the AIM mixture 703, 903 may be, e.g., between 0.001 milligrams and 100,000 milligrams. A volume ratio of headspace volume to AIM mixture 703, 903 ullage volume may be, e.g., less than 50:1. In some embodiments, the volume ratio of headspace volume to AIM mixture 703, 903 ullage volume may be less than 20:1. The AIM capture assembly 704, 904 may comprise, e.g., a cellulosic fabric, a filter paper, or a metal mesh as noted herein. In some embodiments, the AIM capture assembly 704, 904 may comprise a Teflon or Polytetrafluoroethylene (PTFE) seal, e.g., in combination with the cellulosic fabric, filter paper, or metal mesh. The AIM mixture 703, 903 may comprise an autoignition composition designed to initiate combustion of a main pyrotechnic charge in a gas generator, pyrotechnic device, pyrotechnic train, or explosive train exposed to flame or a high temperature environment. The autoignition composition may include a mixture of an oxidizer and a metal or organic fuel. As an example, the autoignition composition may comprise a metal nitrate salt, metal chlorate, metal perchlorate, ammonium perchlorate, a salt nitrite, organic nitrate, organic nitrite, or a solid organic amine, and the fuel and oxidizer may be present in amounts sufficient to provide a desired autoignition temperature. One example is disclosed in U.S. Pat. No. 5,959,242. Any propellant, autoignition material, co-melt, eutectic material, thermite material, or material that is thermally responsive at a specific temperature range and provides a heat, deflagration or explosive output may be used in AIM mixture 703, 903. The autoignition material may optionally be blended with a propellant booster material such as $BKNO_3$ or other propellant or explosive booster. For example, the autoignition material to propellant booster weight ratio may range from: autoignition material:propellant booster=1:99 (wt:wt) to an autoignition material:propellant booster=99:1(wt:wt). In some embodiments, the booster may optionally be separated from the AIM mixture 703, 903 within the AIM capsules 700, 900.

In some AIM capsule embodiments, the AIM mixture 703, 903 may be packaged in a configuration that allows for a hermetic seal to provide a minimum shelf life of 5 or more years and is compact to minimize the trigger weight and volume. Both the stability and performance of the AIM mixture 703, 903 may be dependent on the packaging configuration. Relevant AIM capsule parameters which affect AIM performance include but are not limited to: (i) ullage volume ratio, (ii) AIM blend, (iii) gas and moisture traps, and (iv) capsule (packaging) materials. Adjustment of these parameters may allow tuning of the trigger response temperature in small increments over a wide temperature range from about 90° C. to above 170° C.

Finally, all of the components of an AIM capsule such as illustrated in FIGS. 7-10 may optionally be made of materials that are compatible with the AIM mixture 703, 903. For some applications, the materials may be compatible with acidic components or oxidizing components such as nitric acid or nitrate salts, and transition metals such as molybdenum or nickel, platinum group metals such as silver. All components of the AIM capsule may for example be made from titanium, PTFE, Teflon©, stainless steel, silica-alumina, 4 A zeolite, or cellulosic material.

While certain example techniques have been described and shown herein using various methods, devices and systems, it should be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular examples disclosed, but that such claimed subject matter also may include all implementations falling within the scope of the appended claims, and equivalents thereof.

The invention claimed is:

1. An autoignition material capsule, comprising:

a hermetically or environmentally sealed capsule configured for engagement in an application that responds to slow cook off and fast cook off;

an autoignition material disposed inside the hermetically or environmentally sealed capsule;

a gas permeable retainer system which retains the autoignition material in position; and a burst orifice for gas output upon activation of the autoignition material;

wherein the autoignition material is configured to activate in response to the slow cook off and the fast cook off, resulting in the gas output into the application via the burst orifice.

2. The autoignition material capsule of claim 1, wherein the application comprises a thermal trigger device, and further comprising a port interface for engaging the autoignition material capsule in the thermal trigger device.

3. The autoignition material capsule of claim 1, further comprising a stabilizer disposed inside a holder assembly.

4. The autoignition material capsule of claim 3, wherein the stabilizer comprises a molecular sieve, a water or gas absorbing material, zeolite, or silica.

5. The autoignition material capsule of claim 1, wherein a weight of the autoignition material is between 0.001 milligrams and 100,000 milligrams.

6. The autoignition material capsule of claim 1, wherein a volume ratio of headspace volume to autoignition material ullage volume is less than 50:1.

7. The autoignition material capsule of claim 1, wherein the gas permeable retainer system comprises a breathable filter that retains the autoignition material having particle sizes as low as <10 μm while allowing penetration of gases that form during storage and/or use of the autoignition material capsule.

8. The autoignition material capsule of claim 7, wherein the gas permeable retainer system comprises a cellulosic fabric, a filter paper, or a metal mesh.

9. The autoignition material capsule of claim 1, wherein the autoignition material is blended with a propellant booster material.

10. The autoignition material capsule of claim 9, wherein the propellant booster material comprises $BKNO_3$.

11. The autoignition material capsule of claim 1, wherein the autoignition material capsule is adapted to initiate a pyrotechnic train in the application.

12. The autoignition material capsule of claim 1, wherein the hermetically or environmentally sealed capsule is a hermetically sealed capsule.

13. The autoignition material capsule of claim 1, wherein the hermetically or environmentally sealed capsule comprises a slidable capsule body inside a capsule closure assembly, and wherein the slidable capsule body is configured to slide outward from the capsule closure assembly upon activation of the autoignition material.

14. The autoignition material capsule of claim 13, further comprising at least one o-ring adapted to stabilize and retain the slidable capsule body inside the capsule closure assembly.

15. The autoignition material capsule of claim 1, further comprising an orifice disc retainer adapted to provide a hermetic or environmental seal at the burst orifice, wherein the orifice disc retainer meters gases and pressure inside the autoignition material capsule during activation of the autoignition material.

16. The autoignition material capsule of claim 1, wherein the autoignition material is packaged within the autoignition material capsule to achieve a shelf life of at least five years.

* * * * *